US011274256B2

(12) United States Patent
Yamaguchi et al.

(10) Patent No.: US 11,274,256 B2
(45) Date of Patent: Mar. 15, 2022

(54) APPARATUS FOR SEPARATION AND RECOVERY OF HYDROCARBONS FROM LNG

(71) Applicant: TOYO ENGINEERING CORPORATION, Tokyo (JP)

(72) Inventors: Shoichi Yamaguchi, Narashino (JP); Yasuyuki Yamamori, Narashino (JP); Xiaoxue Zhang, Narashino (JP)

(73) Assignee: TOYO ENGINEERING CORPORATION, Tokyo (JP)

( * ) Notice: Subject to any disclaimer, the term of this patent is extended or adjusted under 35 U.S.C. 154(b) by 198 days.

(21) Appl. No.: 16/168,593

(22) Filed: Oct. 23, 2018

(65) Prior Publication Data

US 2019/0136141 A1 May 9, 2019

(30) Foreign Application Priority Data

Nov. 6, 2017 (JP) ..... JP2017-213428

(51) Int. Cl.
*C10G 5/06* (2006.01)
*C10G 5/04* (2006.01)
*F25J 3/02* (2006.01)

(52) U.S. Cl.
CPC ..... *C10G 5/06* (2013.01); *C10G 5/04* (2013.01); *F25J 3/0214* (2013.01); *F25J 3/0233* (2013.01);
(Continued)

(58) Field of Classification Search
CPC ..... F25J 3/0242; F25J 3/0233; F25J 3/0238; F25J 3/0247; F25J 3/0257; F25J 3/0615;
(Continued)

(56) References Cited

U.S. PATENT DOCUMENTS 2,952,984 A 9/1960 Marshall, Jr.
6,405,561 B1 * 6/2002 Mortko ..... F25J 3/0209 62/631

(Continued)

FOREIGN PATENT DOCUMENTS

JP 2007-024489 A 2/2007
JP 2008-505208 A 2/2008

(Continued)

OTHER PUBLICATIONS

Distillation Columns—Internal Reflux Control—Jim Ford (Aug. 2012) (Year: 2012).*

*Primary Examiner* — Len Tran
*Assistant Examiner* — Jenna M Hopkins
(74) *Attorney, Agent, or Firm* — Foley & Lardner LLP

(57) ABSTRACT

Provided are an apparatus and a method for separation and recovery of propane and heavier hydrocarbons from LNG. The apparatus has, from the upstream side toward the downstream side of LNG supply, first column (3) equipped with first column overhead condenser (2), first column bottom reboiler (4) and side reboiler (5), and second column (14) equipped with second column overhead condenser (11) and second column bottom reboiler (15). The first column (3) separates methane and a part of ethane as an overhead vapor and separates remaining ethane and C3 or higher hydrocarbons as a bottom liquid. The second column (14) separates ethane as an overhead vapor and separates C3 or higher hydrocarbons as a bottom liquid.

7 Claims, 7 Drawing Sheets

(52) U.S. Cl.
CPC .... *F25J 3/0242* (2013.01); *C10G 2300/1025* (2013.01); *C10G 2400/28* (2013.01); *F25J 2200/02* (2013.01); *F25J 2200/04* (2013.01); *F25J 2200/50* (2013.01); *F25J 2200/70* (2013.01); *F25J 2200/72* (2013.01); *F25J 2200/78* (2013.01); *F25J 2205/04* (2013.01); *F25J 2210/06* (2013.01); *F25J 2230/60* (2013.01); *F25J 2235/60* (2013.01)

(58) Field of Classification Search
CPC .. F25J 3/064; F25J 3/0645; F25J 3/065; F25J 3/066; F25J 3/0214; F25J 3/0209; F25J 2200/04
See application file for complete search history.

(56) References Cited

U.S. PATENT DOCUMENTS

| | | | | |
|---|---|---|---|---|
| 6,510,706 | B2 | 1/2003 | Stone et al. | |
| 7,216,507 | B2 | 5/2007 | Cuellar et al. | |
| 8,794,029 | B2 * | 8/2014 | Yokohata | F25J 3/0233 62/620 |
| 2006/0277943 | A1 | 12/2006 | Yokohata et al. | |
| 2009/0221864 | A1 * | 9/2009 | Mak | F25J 3/0214 585/803 |
| 2011/0265511 | A1 * | 11/2011 | Fischer | F25J 1/0292 62/611 |
| 2012/0000245 | A1 * | 1/2012 | Currence | F25J 3/0242 62/620 |
| 2015/0267137 | A1 * | 9/2015 | Sapper | F25J 3/0247 62/620 |

FOREIGN PATENT DOCUMENTS

| | | | | |
|---|---|---|---|---|
| JP | 2009-538372 | A | 11/2009 | |
| WO | WO-03085340 | A2 * | 10/2003 | F25J 3/0214 |
| WO | WO 2006/118583 | A1 | 11/2006 | |
| WO | WO 2007/139876 | A2 | 12/2007 | |

* cited by examiner

APPARATUS FOR SEPARATION AND RECOVERY OF HYDROCARBONS FROM LNG

This application is based upon and claims the benefit of priority from Japanese patent application No. 2017-213428, filed on Nov. 6, 2017 the disclosure of which is incorporated herein in its entirety by reference.

BACKGROUND OF THE INVENTION

Field of the Invention

The present invention relates to an apparatus for hydrocarbon separation and recovery for use in separating and recovering a hydrocarbon containing a liquefied petroleum gas (LPG) fraction, such as propane and butane, from liquefied natural gas (LNG).

Description of the Related Art

LNG is received and stored in LNG tanks in LNG receiving terminals of consuming countries after liquefaction and export by producing countries. In order to utilize LNG as fuel gas in end users, LNG is pressurized by a pump and then vaporized and sent out to a natural gas pipeline.

Methane is a major portion among hydrocarbon components in LNG. LNG also contains heavier hydrocarbon components such as ethane, propane and butane, as well as nitrogen. When LNG contains a large amount of heavier hydrocarbons, the heating value of the LNG becomes high, and therefore the LNG may not meet the pipeline natural gas specification required for users in each region.

Since heavier hydrocarbons can be used as raw materials in petrochemical plants, they may have a higher market value than in the case when they are utilized as city gas or the fuel of thermal power plants. Accordingly, it may be desirable to separate and recover heavier hydrocarbons from feed LNG received in the LNG receiving terminals before the LNG is sent to natural gas pipelines.

Various reports have been made on processes to separate propane and heavier hydrocarbons from LNG. In the conventional processes, however, a separation apparatus for achieving a high propane recovery rate has a relatively large size and a complicated configuration and therefore requires a relatively large energy consumption.

U.S. Pat. No. 6,510,706 has reported a process for hydrocarbon separation from LNG using a single distillation column. In this process, feed LNG is used as reflux liquid. Therefore, a sufficient reflux effect cannot be obtained, and the propane recovery rates is relatively low.

FIG. 1 is a flow diagram of U.S. Pat. No. 6,510,706 and illustrates a conventional one-column apparatus for separation of propane and heavier hydrocarbons from LNG.

Feed LNG 21 at around −159° C. supplied from an LNG tank (not shown) is pressurized by feed LNG pump 1, and a part 33 of the pressurized feed LNG 21*a* flows through distillation column overhead condenser 2 of distillation column 3, and supplied to a middle of distillation column 3.

Meanwhile, the remaining part 24 of the feed LNG is bypassed around distillation column overhead condenser 2, and is supplied to the top of distillation column 3 as reflux liquid. Overhead vapor 22 of distillation column 3 is supplied to distillation column overhead condenser 2 at 2,350 kPaA and −72° C., cooled to −101° C. by heat exchange with feed LNG 33 and totally condensed.

Totally condensed liquid (overhead condensed liquid) 22*a* flows through distillation column reflux drum 9, and is pressurized to a pipeline pressure of 9,411 kPaA by product LNG pump 10 and returned to an LNG terminal.

The bottom liquid of distillation column 3 is at 75° C., and is heated in distillation column bottom reboiler 4 so that the C2/C3 molar ratio in bottom product LPG is 0.02 or less.

Table 1 summarizes material balance, recovery rates and energy consumptions for the process illustrated in FIG. 1.

In order to compare with the other related arts in terms of energy consumption and equipment configuration, common feed LNG composition is used. The composition used herein as an example of the feed LNG is 0.5% by mole of nitrogen, 86.7% by mole of methane, 8.9% by mole of ethane, 2.9% by mole of propane and 1.0% by mole of butane. The same holds true for FIGS. 2 to 7.

Any heat leak between the surroundings and the process equipment having very low temperatures is not taken into account for calculation, assuming that the amount of the heat leak is sufficiently small. The application of commercially available cold insulating materials to the equipment minimizes such heat leak and makes this assumption reasonable.

TABLE 1

Material balance, Recovery Rate and Energy Consumption (FIG. 1)

| Stream Flow Rate - kg moles/Hr | | | | | |
|---|---|---|---|---|---|
| Stream | Methane | Ethane | Propane | Butane | Total |
| 21 | 9,524 | 977 | 322 | 109 | 10,979 |
| 22 | 9,524 | 971 | 12 | 1 | 10,555 |
| 24 | 1,238 | 127 | 42 | 14 | 1,427 |
| 25 | 9,524 | 971 | 12 | 1 | 10,555 |
| 30 | 0 | 6 | 310 | 108 | 424 |
| 33 | 8,286 | 850 | 280 | 95 | 9,552 |

| Recovery Rate | |
|---|---|
| Propane | 96.28% |
| Butane | 99.13% |

| Required Power | |
|---|---|
| Feed LNG pump | 355 kw |
| Product LNG pump | 1,311 kw |
| Total | 1,666 kw |

| Supply of External Heat | |
|---|---|
| Distillation column bottom reboiler | 13,448 kw |
| Total | 13,448 kw |

In U.S. Pat. No. 2,952,984, since condensed overhead vapor of a distillation column is used as reflux liquid, the reflux effect is high and a high propane recovery rate can be obtained. However, since methane and ethane components contained in LNG are vaporized and separated from propane and butane components in a single distillation column, the vapor load in the distillation column becomes relatively high. Therefore, the diameter of the distillation column is disadvantageously large.

FIG. 2 is a flow diagram of U.S. Pat. No. 2,952,984 and illustrates a conventional one-column apparatus for separation of propane and heavier hydrocarbons from LNG.

Feed LNG 21 at around −159° C. supplied from an LNG tank is pressurized by feed LNG pump 1, flows through distillation column overhead condenser 2 of distillation column 3, and supplied to a middle of distillation column 3. In distillation column overhead condenser 2, feed LNG gives its cold heat to overhead vapor 22 of distillation column 3, and the feed LNG is heated to −86° C.

Overhead vapor 22 of distillation column 3 is supplied to distillation column overhead condenser 2 at 2,600 kPaA and −72° C., cooled to −98° C. by heat exchange with feed LNG 21*a* and totally condensed.

Totally condensed liquid 22*a* flows through distillation column reflux drum 9 and distillation column reflux pump 6, and a part 24 thereof is supplied to the top of distillation column 3 as reflux liquid.

The remaining liquid is pressurized to a pipeline pressure of 9,411 kPaA by product LNG pump 10 and returned to an LNG receiving terminal. The bottom liquid of distillation column 3 is at 80° C., and is heated in distillation column bottom reboiler 4 so that the C2/C3 molar ratio in bottom product LPG is 0.02 or less. Table 2 summarizes material balance, recovery rates and energy consumptions for the process illustrated in FIG. 2.

TABLE 2

Material balance, Recovery Rate and Energy Consumption (FIG. 2)

| Stream Flow Rate - kg moles/Hr | | | | | |
|---|---|---|---|---|---|
| Stream | Methane | Ethane | Propane | Butane | Total |
| 21 | 9,524 | 977 | 322 | 109 | 10,979 |
| 22 | 11,205 | 1,142 | 2 | 0 | 12,404 |
| 24 | 1,681 | 171 | 0 | 0 | 1,861 |
| 25 | 9,524 | 971 | 1 | 0 | 10,543 |
| 30 | 0 | 6 | 320 | 109 | 436 |

| Recovery Rate | |
|---|---|
| Propane | 99.47% |
| Butane | 100.00% |

| Required Power | |
|---|---|
| Feed LNG pump | 393 kw |
| Distillation column reflux pump | 22 kw |
| Product LNG pump | 1,272 kw |
| Total | 1,687 kw |

| Supply of external heat | |
|---|---|
| Distillation column bottom reboiler | 14,319 kw |
| Total | 14,319 kw |

Since the condensed liquid of the overhead vapor of the distillation column is used as reflux liquid, a higher propane recovery rate 99.47% is achieved than 96.28% in the process illustrated in FIG. 1.

In U.S. Pat. No. 7,216,507, two distillation columns are used for separating propane and butane from LNG. Therefore, the vapor load in the first distillation column (counted from the upstream side) can be reduced than in the case where only one column is used.

To send the overhead vapor of the first column (first overhead vapor) to natural gas pipelines, the first overhead vapor should be pressurized to a pipeline pressure and then returned to an LNG receiving terminal. When the first overhead vapor of this distillation column is sent back to the LNG receiving terminal, the energy required for the pressurization is lower (i.e. the efficiency is higher) in the case of liquefying the vapor and then pressurizing the resulting liquid than in the case of compressing the vapor in a gaseous phase.

Therefore, it is desirable to totally condense the first overhead vapor. The total condensation is achieved by elevating the operating pressure. Meanwhile, the first column is a unit, or distillation column, having the largest volume in the separation apparatus because it treats methane contained as the major component in feed LNG. Therefore, it is preferable to reduce the operating pressure of the first column, and thereby, to reduce the load in the first column and to reduce the required wall thickness of a pressure vessel of the first column.

FIG. 3 is a flow diagram of U.S. Pat. No. 7,216,507 and illustrates a conventional two-column apparatus for separation of propane and heavier hydrocarbons from LNG.

Feed LNG 21 at around −159° C. supplied from an LNG tank (not shown) is pressurized by feed LNG pump 1, flows through first column overhead condenser 2, cold heat recovery exchanger 7 and feed LNG preheater 8, and is supplied to a middle of first column 3.

In first column overhead condenser 2, the feed LNG is heated to −76° C. by giving its cold heat to overhead vapor 22 of first column 3 (feed LNG 21*b*).

Further, feed LNG 21*b* is heated to −74° C. by giving cold heat to product LPG 30 from the bottom of second column 14 in cold heat recovery exchanger 7 (21*c*), and then heated to −48° C. by an external heat source in feed LNG preheater 8 (21*d*).

Heated feed LNG 21*d* is then supplied to first column 3, and brought into direct contact with liquid coming from the upper part of the column. Thereby, C3+ NGL (Natural Gas Liquid, hydrocarbons having 3 or more carbon atoms) components are absorbed in the liquid phase.

First overhead vapor 22 of first column 3 is supplied to first column overhead condenser 2 at −68° C. and 3,206 kPaA, cooled to −91° C. by the cold heat of the feed LNG as mentioned above and totally condensed.

Totally condensed liquid 22*a* flows through first column reflux drum 9 and first column reflux pump 6, and a part thereof is supplied to the overhead of first column 3 as reflux liquid 24.

Remaining totally condensed liquid 25 is pressurized to a pipeline pressure of 9,411 kPaA by product LNG pump 10 (25*a*) and returned to an LNG receiving terminal. Bottom liquid of first column 3 from first bottom liquid line 26 is supplied to second column 14 at −52° C. and 2,965 kPaA by its own pressure. In second column 14, vapor of methane and ethane is generated by heat supplied by second column bottom reboiler 15, and distillation operation is performed so that the C2/C3 molar ratio in the bottom product LPG can be 0.02 or less.

Product LPG 30 flows from the bottom of second column 14 to cold heat recovery exchanger 7 at 88° C., and is subcooled to −18° C. by feed LNG 21*b* and discharged out of the system (30*a*).

Overhead vapor 27 of second column 14 (second overhead vapor) is supplied at −7° C. to first column overhead condenser 2, cooled to −72° C., and totally condensed (27*a*).

Totally condensed liquid 27*a* is pressurized by second column reflux pump 13 (27*b*), then returned to first column overhead condenser 2 and heated to −57° C. by giving its own latent heat to become a multi-phase stream, a part of which is vapor. This multi-phase stream is supplied to first column 3 as second reflux liquid 27*c*.

The second reflux liquid 27*c* has the function of absorbing propane and heavier hydrocarbons contained in the vapor inside the column and concentrating C3+ NGL components in the liquid inside the column. Table 3 summarizes material balance, recovery rates and energy consumptions for the process illustrated in FIG. 3.

TABLE 3

| Material balance, Recovery Rate and Energy Consumption (FIG. 3) | | | | | |
|---|---|---|---|---|---|
| Stream Flow Rate - kg moles/Hr | | | | | |
| Stream | Methane | Ethane | Propane | Butane | Total |
| 21 | 9,524 | 977 | 322 | 109 | 10,979 |
| 22 | 10,934 | 1,115 | 4 | 0 | 12,107 |
| 24 | 1,410 | 144 | 1 | 0 | 1,562 |
| 25 | 9,524 | 971 | 3 | 0 | 10,545 |
| 26 | 582 | 458 | 396 | 116 | 1,552 |
| 27 | 582 | 452 | 77 | 7 | 1,118 |
| 30 | 0 | 6 | 319 | 109 | 434 |
| Recovery Rate | | | | | |
| Propane | | | | 99.03% | |
| Butane | | | | 100.00% | |
| Required Power | | | | | |
| Feed LNG pump | | | | 534 kW | |
| First column reflux pump | | | | 110 kW | |
| Second column reflux pump | | | | 18 kW | |
| Product LNG pump | | | | 1,251 kW | |
| Total | | | | 1,913 kw | |
| Supply of External Heat | | | | | |
| Feed LNG preheater | | | | 9,010 kw | |
| Second column reboiler | | | | 5,292 kw | |
| Total | | | | 14,302 kw | |

An object of the present invention is to provide an apparatus for separation and recovery of propane and heavier hydrocarbons from LNG.

SUMMARY OF THE INVENTION

The present invention provides an apparatus for separation and recovery of propane and heavier hydrocarbons (hydrocarbons heavier than propane) from LNG, comprising, from the upstream side toward the downstream side of LNG flow from an LNG feed source, a first column (3) equipped with a first column overhead condenser (2), a first column bottom reboiler (4) and a side reboiler (5), and a second column (14) equipped with a second column overhead condenser (11) and a second column bottom reboiler (15), wherein the first column (3) is configured to separate feed LNG into a first overhead vapor containing methane and ethane, and a first bottom liquid containing remaining ethane, propane and heavier hydrocarbons, the second column (14) is configured to separate the first bottom liquid into a second overhead vapor containing ethane, and a second bottom liquid containing propane and heavier hydrocarbons, the LNG feed source and the first column (3) are connected by a feed LNG line (21, 21*a* and 21*b*), in which the first column overhead condenser (2) is provided, the overhead of the first column (3) and the first column overhead condenser (2) are connected by a first overhead vapor line (22) for transferring the first overhead vapor, the first column overhead condenser (2) is connected to a first overhead vapor condensed liquid line (22*a* and 22*b*) for withdrawing a first overhead vapor condensed liquid which is the first overhead vapor totally condensed in the first column overhead condenser (2), downstream of the first overhead vapor condensed liquid line (22*a* and 22*b*), there is provided a product LNG pump (10), and further, downstream of the product LNG pump (10), there is provided a product LNG discharge line (25) for discharging the first overhead vapor condensed liquid as product LNG, the bottom of the first column (3) and the second column (14) are connected by a first bottom liquid line (26) for transferring the first bottom liquid, the second column (14) is connected to a second reflux line (27, 27*a*, 27*b* and 28) through which the second overhead vapor is withdrawn from the overhead of the second column and sent back to an upper section of the second column (14), through the second reflux line (27, 27*a*, 27*b* and 28), the second overhead vapor is withdrawn from the overhead of the second column (14), then, a condensed second overhead vapor is obtained in the second column overhead condenser (11), and then, a part of the condensed second overhead vapor is sent back to the upper section of the second column (14) via second column reflux drum (12), wherein the second reflux line at a position between second column reflux pump (13) and the upper section of the second column (14) is connected to the first column (3) by a third reflux line (29) which sends back another part of the condensed second overhead vapor (ethane) to the first column (3), and the bottom of the second column (14) is connected to an LPG recovery line (30) through which the second bottom liquid is recovered as product LPG.

The present invention also provides a method for hydrocarbon separation using the same.

The present invention further provides an apparatus for separation and recovery of propane and heavier hydrocarbons from LNG, comprising, from the upstream side toward the downstream side of LNG flow from an LNG feed source, a first column (3) equipped with a first column overhead condenser (2), a first column bottom reboiler (4) and a side reboiler (5), and a second column (14) equipped with a second column overhead condenser (11) and a second column bottom reboiler (15), wherein the first column (3) is configured to separate feed LNG into a first overhead vapor containing methane and ethane, and a first bottom liquid containing remaining ethane, propane and heavier hydrocarbons, the second column (14) is configured to separate the first bottom liquid into a second overhead vapor containing ethane, and a second bottom liquid containing propane and heavier hydrocarbons, the LNG feed source and the first column (3) are connected by a feed LNG line (21, 21*a* and 21*b*), in which the first column overhead condenser (2) is provided, the overhead of the first column (3) and the first column overhead condenser (2) are connected by a first overhead vapor line (22) for transferring the first overhead vapor, the first column overhead condenser (2) is connected to a first overhead vapor condensed liquid line (22*a* and 22*b*) for withdrawing a first overhead vapor condensed liquid which is the first overhead vapor totally condensed in the first column overhead condenser (2), downstream of the first overhead vapor condensed liquid line (22*a* and 22*b*), there is provided a first reflux line (24) for supplying a part of the first overhead vapor condensed liquid as a reflux liquid to the first column via a first column reflux pump (6), and further, downstream of the first overhead vapor condensed liquid line (22*a* and 22*b*), there is provided a product LNG discharge line (25) for discharging the remaining of the first overhead vapor condensed liquid as product LNG via a product LNG pump (10), the bottom of the first column (3) and the second column (14) are connected by a first bottom liquid line (26) for transferring the first bottom liquid, the second column (14) is connected to a second reflux line (27, 27*a*, 27*b* and 28) through which the second overhead vapor is withdrawn from the overhead of the second column and sent back to an upper section of the second column (14), through the second reflux line (27, 27*a*, 27*b* and 28), the second overhead vapor is withdrawn from the overhead of the second column (14), then, a condensed second overhead vapor is obtained in the second column overhead condenser (11), and then, a part of the condensed second overhead vapor is sent back to the upper section of the second column (14) via second column reflux drum (12), wherein the second reflux line at a position between second column reflux pump (13) and the upper section of the second column (14) is connected to the first column (3) by a third reflux line (29) which sends back another part of the condensed second overhead vapor (ethane) to the first column (3), and the bottom of the second column (14) is connected to an LPG recovery line (30) through which the second bottom liquid is recovered as product LPG.

The present invention also provides a method for hydrocarbon separation using the same.

According to an aspect of the present invention, provided is a method for separating hydrocarbons wherein feed liquefied natural gas (LNG) containing methane, ethane, and a hydrocarbon having 3 or more carbon atoms including at least propane is separated into a liquid fraction enriched in methane and ethane and a liquid fraction enriched in the hydrocarbon having 3 or more carbon atoms, comprising:

(a) heating the feed LNG in a first column overhead condenser to partially vaporize the feed LNG to obtain a vapor-liquid two-phase stream;

(b) supplying the whole or a liquid phase of the vapor-liquid two-phase stream to a middle of a first column so that the supplied vapor-liquid two-phase stream is separated by the first column into a first overhead vapor enriched in methane and ethane, and a first bottom liquid enriched in the hydrocarbon having 3 or more carbon atoms;

(c) separating the first bottom liquid into a second overhead vapor enriched in ethane and a second bottom liquid enriched in the hydrocarbon having 3 or more carbon atoms by a second column;

(d) totally condensing the second overhead vapor in a second column overhead condenser to obtain a condensed liquid of the second overhead vapor;

(e) supplying a part of the condensed liquid of the second overhead vapor to the first column while refluxing the remaining part to the second column;

(f) totally condensing the first overhead vapor obtained from step (b) by heat exchange with the feed LNG in the first column overhead condenser to obtain a condensed liquid of the first overhead vapor;

(g) discharging the whole or part of the liquid stream obtained from step (f) as the liquid fraction enriched in methane and ethane; and (h) discharging the second bottom liquid as the liquid fraction enriched in the hydrocarbon having 3 or more carbon atoms.

Use of the separation and recovery apparatus of the present invention can separate feed LNG to obtain light LNG (product LNG) enriched in methane and ethane, and propane and heavier hydrocarbons (product LPG) including propane and butane.

Furthermore, the separation and recovery apparatus of the present invention utilizes cold heat of the feed LNG as a cold heat source of a first column overhead condenser.

Moreover, in separation and recovery using the apparatus of the present invention, a lower operating pressure of a distillation column can improve the separation efficiency, which can in turn reduce a necessary amount of reflux liquid and relatively reduce the vapor load in the distillation column. In addition, this also reduces heat duty of the distillation column. Hence, lower energy consumption than that in the related arts (U.S. Pat. Nos. 6,510,706, 2,952,984 and 7,216,507) can be achieved.

Figure 4:
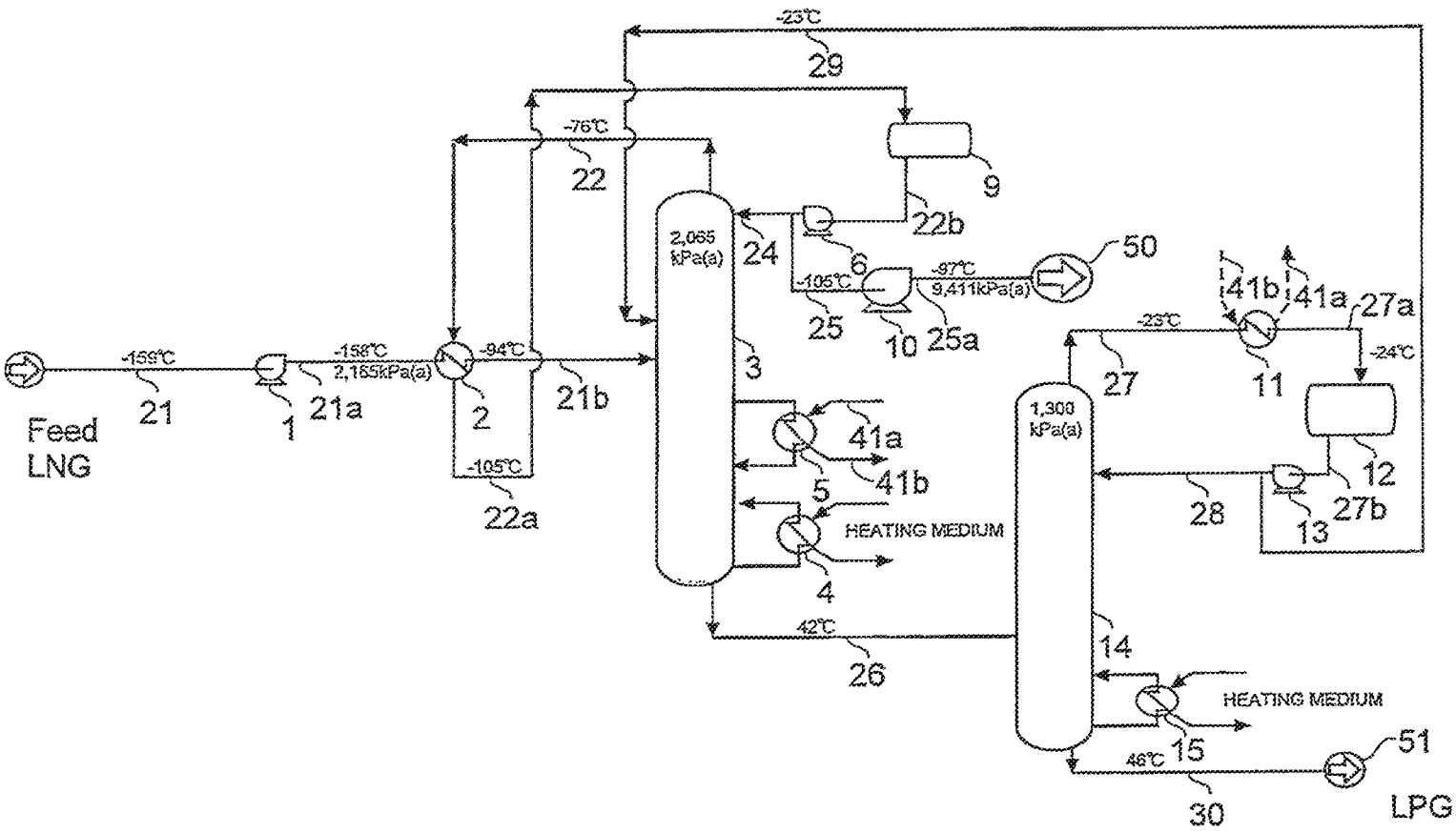
FIG. 4 is a flow diagram illustrating separation of propane and heavier hydrocarbons from LNG in accordance with an embodiment of the present invention.

DETAILED DESCRIPTION OF THE PREFERRED EMBODIMENTS (1) Apparatus and Process for Separation and Recovery of FIG. 4

An apparatus for separation and recovery of propane and heavier hydrocarbons from LNG (hereinafter, referred to as a "separation and recovery apparatus") illustrated in FIG. 4 will be described.

Figure 5:
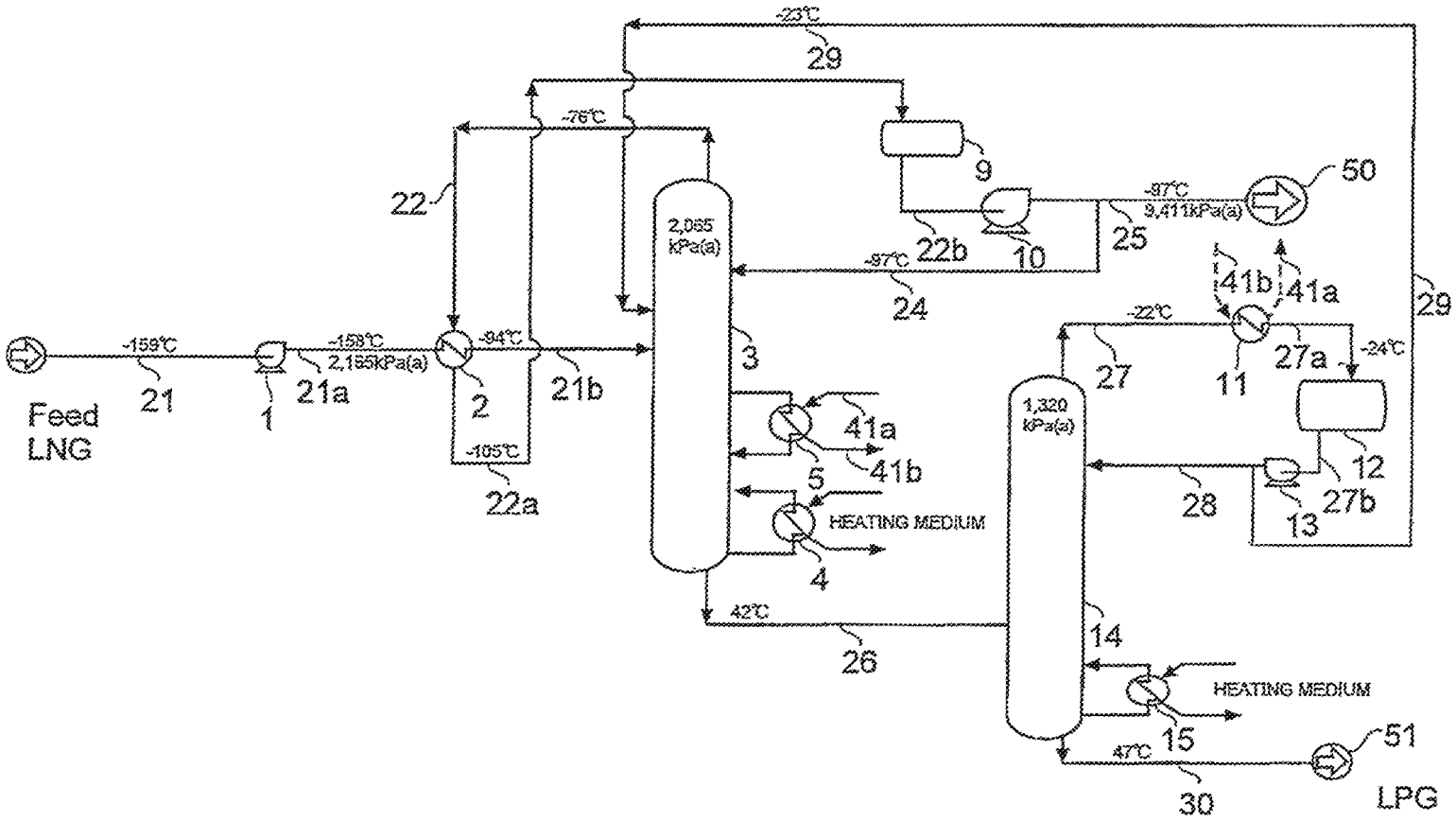
FIG. 5 is a flow diagram illustrating separation in accordance with another embodiment which is the same as that shown in FIG. 4 except that a first column reflux pump is not used.
Figure 6:
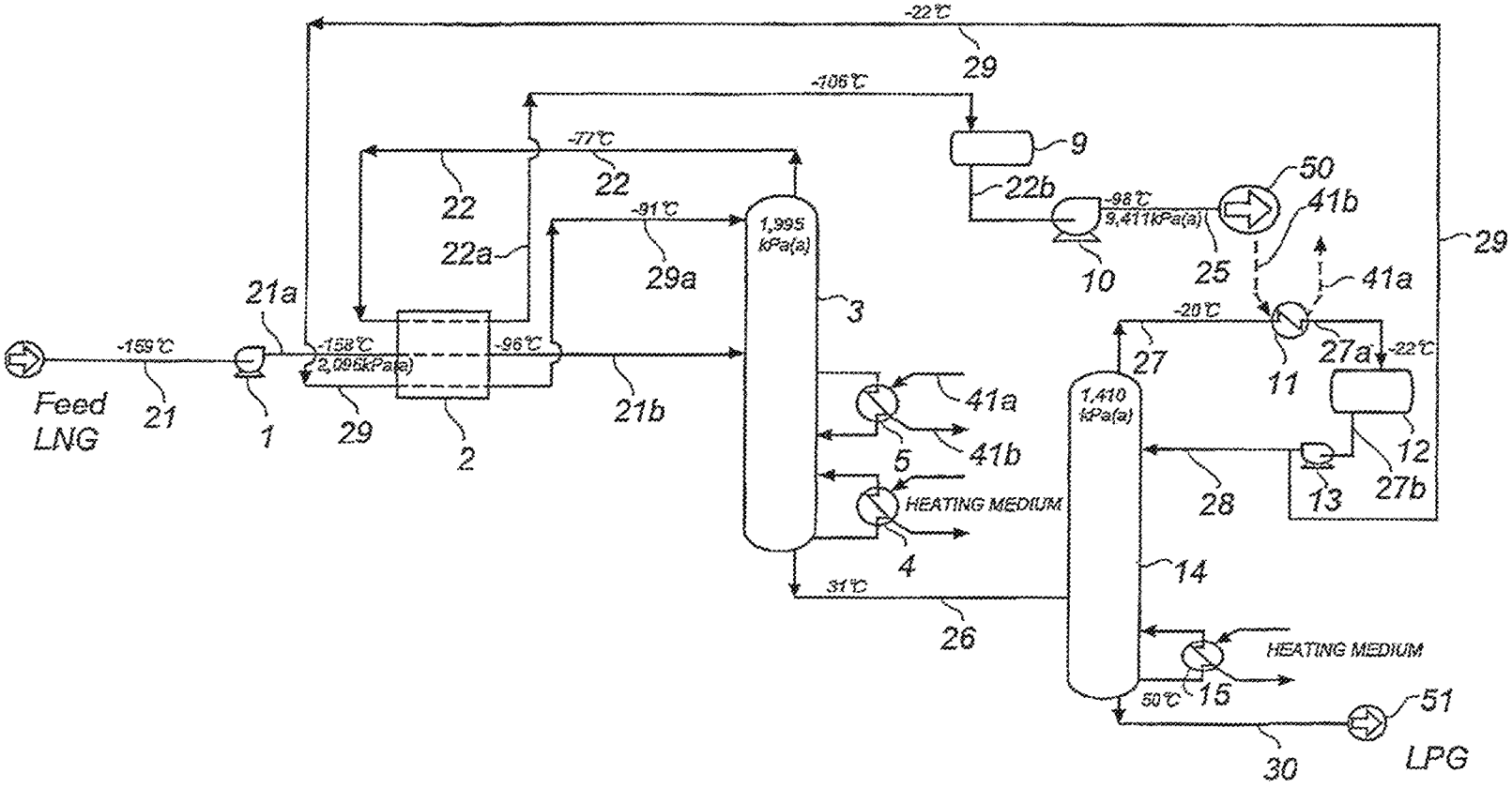
FIG. 6 is a flow diagram illustrating separation of propane and heavier hydrocarbons from LNG in accordance with a further embodiment of the present invention.
Figure 7:
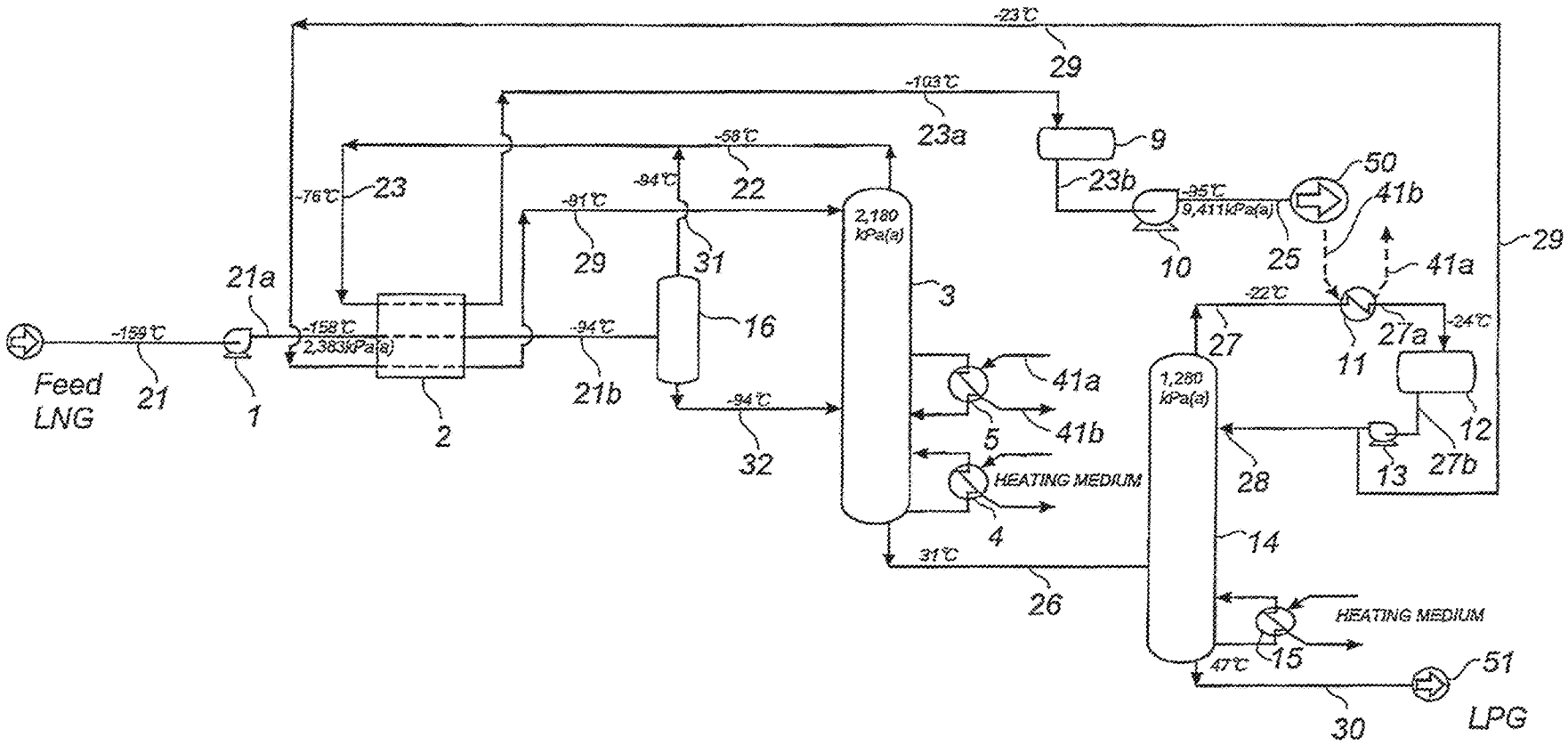
FIG. 7 is a flow diagram illustrating separation in accordance with a still further embodiment which is the same as that shown in FIG. 6 except that an additional LNG separator is used.

LNG is received and stored in LNG tanks in LNG receiving terminals of consuming countries after liquefaction and export by producing countries. Therefore, LNG feed source is the LNG receiving terminal described above. The same holds true for apparatuses illustrated in FIGS. 5 to 7 given below.

The separation and recovery apparatus illustrated in FIG. 4 has process equipment necessary for separation and recovery, including first column (first distillation column) 3 equipped with feed LNG pump 1, first column overhead condenser 2, first column bottom reboiler 4 and side reboiler 5, and second column (second distillation column) 14 equipped with second column overhead condenser 11 and second column bottom reboiler 15, from the upstream side toward the downstream side of LNG flow from the LNG feed source (LNG terminal).

These units are interconnected by lines made of steel (e.g., stainless) pipes. Each line and line branch may be provided, if necessary, with a control valve, an on-off valve, various sensors such as a flow rate sensor, a pressure sensor and a temperature sensor, etc.

First column 3 separates the feed LNG into a first overhead vapor mainly containing methane, and a first bottom liquid containing ethane, propane and heavier hydrocarbons.

First column bottom reboiler 4 and side reboiler 5 are provided to the bottom of first column 3. First column bottom reboiler 4 can employ a known heat exchanger using steam, heat transfer oil or the like in heating.

Second column 14 is used for separating the first bottom liquid separated in first column 3 into liquefied ethane and a second bottom liquid containing propane and heavier hydrocarbons.

Second column bottom reboiler 15 is provided to the bottom of second column 14. Second column bottom reboiler 15 can employ a known heat exchanger using steam, heat transfer oil or the like in heating.

The distillation column for use as first column 3 or second column 14 can employ a known multistage distillation column. The multistage distillation column may be any of tray columns and packed columns and is preferably of continuous distillation type.

The theoretical number of stages of the distillation column is not particularly limited and is preferably 5 or more stages, more preferably 10 or more stages.

The LNG feed source (LNG receiving terminal) and first column 3 are connected by feed LNG line 21, 21*a* and 21*b*. Feed LNG line 21, 21*a* and 21*b* is provided with feed LNG pump 1 and first column overhead condenser 2 in order from the upstream side.

Feed LNG line 21*b* is connected to a middle of first column 3. The "middle" of first column 3 is in the range of, for example, the 5th to 10th stages for 15-stage first column 3. The same holds true for second column 14.

The overhead of first column 3 and first column overhead condenser 2 are connected by first overhead vapor line 22. First column overhead condenser 2 liquefies the first overhead vapor sent from first column 3.

In first column overhead condenser 2, heat is exchanged between the feed LNG and the first overhead vapor, which flow within feed LNG line 21*a* and first overhead vapor line 22, respectively, so that the first overhead vapor is cooled and totally condensed.

First column overhead condenser 2 and port 50 for taking the totally condensed first overhead vapor (first overhead vapor condensed liquid) are connected by first overhead vapor condensed liquid line 22*a* and 22*b* (and also by line 25), in order to send out the first overhead vapor condensed liquid obtained in first column overhead condenser 2.

Port 50 for taking the first overhead vapor condensed liquid is connected to the LNG feed source (LNG receiving terminal). The LNG receiving terminal sends the product to each user.

Downstream of first overhead vapor condensed liquid line 22*a* and 22*b*, there is provided LNG pump 10 via line 25. Further, downstream of LNG pump 10, there is provided product LNG discharge line 25*a* which sends out a part of the first overhead vapor condensed liquid as product LNG.

In addition, downstream of first overhead vapor condensed liquid line 22*a* and 22*b*, there is also provided first reflux line 24 for supplying the remaining part of the first overhead vapor condensed liquid as a reflux liquid to first column 3 via first column reflux pump 6.

Specifically in the embodiment shown in FIG. 4, downstream of first overhead vapor condensed liquid line (22*a* and 22*b*), there are first column reflux pump 6, line 25, product LNG pump 10, product LNG discharge line 25*a*, and port 50. Reflux line 24 is branched from line 25.

In an alternative embodiment (not shown), the first overhead vapor condensed liquid line (22*b*) may be divided into two lines. One of the two divided lines is used as a first reflux line which includes first column reflux pump. The other is used for discharging product LNG.

The bottom of first column 3 and second column 14 are connected by first bottom liquid line 26 for transferring the first bottom liquid separated in first column 3.

Second column 14 is connected to second reflux line 27 (27, 27*a* and 27*b*) and 28, through which the second reflux liquid flows from the overhead of second column 14 and returns to the first upper stage of second column 14.

Second reflux line 27 and 28 is a line from the overhead of second column 14, through second column overhead condenser 11, second column reflux drum 12 and second column reflux pump 13 in order, back to the upper section of second column 14.

Further, second reflux line 28, at a position between second column reflux pump 13 and second column 14, is connected to the upper section of first column 3 by third reflux line 29 which sends back liquefied ethane to the upper section of first column 3. The term "upper (section)" means a position closer to the overhead than an intermediate position in the height direction of first column 3.

Second column overhead condenser 11 and first column side reboiler 5 are connected by first circulation line 41*a* and second circulation line 41*b*, in order to circulate an anti-freezing liquid (intermediate heating medium).

Through first circulation line 41*a*, the anti-freezing liquid flows from second column overhead condenser 11 to side reboiler 5. Through second circulation line 41*b*, the anti-freezing liquid flows from side reboiler 5 to second column overhead condenser 11.

The anti-freezing liquid (intermediate heating medium) can be methanol, ethanol, monoethylene glycol or the like.

The bottom of second column 14 is connected to recovery line 30 through which the second bottom liquid is taken.

The second bottom liquid contains propane and heavier hydrocarbons and is taken as product LPG.

Next, a process for separation and recovery of propane and heavier hydrocarbons using the separation and recovery apparatus illustrated in FIG. 4 will be described.

Feed LNG 21 which is from the LNG feed source (LNG terminal) is supplied to a middle of first column 3 at about −159° C. through the use of feed LNG line 21. However, the supply at about −159° C. is carried out only immediately after the start of operation. During steady state operation, a vapor-liquid two-phase stream (step (a)) is supplied to first column 3 at −94° C. because the first overhead vapor sent from first column 3 is heat-exchanged with the feed LNG of about −159° C. in first column overhead condenser 2.

In this operation, the feed LNG is pressurized by feed LNG pump 1 and sent to first column 3 having an operating pressure of 2,065 kPaA.

The feed LNG as the vapor-liquid two-phase stream is distilled in first column 3, where the feed LNG liquid and reflux liquid condensed in first column overhead condenser 2 are repetitively brought into contact with vapor of the feed LNG vaporized by heating in side reboiler 5 and first column bottom reboiler 4. Thereby, a first overhead vapor, which is a low-boiling fraction, containing methane and a part of ethane is obtained by mass transfer to the overhead of the first column, and a first bottom liquid, which is a high-boiling fraction, containing remaining ethane, propane and heavier hydrocarbons is obtained by mass transfer to the bottom of the first column (step (b)).

The first overhead vapor (about −76° C.) flows through first overhead vapor line 22 and then supplied to first column overhead condenser 2 where it is cooled to −105° C. by heat exchange with feed LNG 21*a* and totally condensed to obtain a first overhead vapor condensed liquid (step (f)). In this operation, the feed LNG is heated to −94° C. and sent to first column 3.

According to this process, a system without external refrigerant is obtained by using the cold heat of feed LNG in first column overhead condenser 2 of first column 3.

The first overhead vapor condensed liquid (−105° C.) flows through first overhead vapor condensed liquid line 22*a* and 22*b*, first column reflux drum 9 and first column reflux pump 6. A part thereof is supplied as reflux liquid to the overhead of first column 3 through first reflux line 24.

The remaining part of the first overhead vapor condensed liquid (−105° C.) flows through line 25, LNG pump 10, and product LNG discharge line 25*a*, during which the stream is pressurized to 9,411 kPaA. The pressurized liquid at −97° C. is returned to the LNG receiving terminal from port 50 for taking the first overhead vapor condensed liquid (step (g)).

The first bottom liquid of first column 3 is heated by first column bottom reboiler 4 to 42° C. under the condition that the C2/C3 molar ratio is 0.5.

The first bottom liquid is supplied to second column 14 through first bottom liquid line 26.

In second column 14, by the heating in second column reboiler 15, an ethane fraction is vaporized, and stream 26 is separated into a second overhead vapor enriched (increased content) in ethane, and column bottom product LPG (second bottom liquid) enriched in the hydrocarbon having 3 or more carbon atoms (step (c)).

The second bottom liquid has a C2/C3 molar ratio of 0.02 or less. The product LPG (second bottom liquid) is 46° C. under the condition that the operating pressure is 1,300 kPaA.

The product LPG (second bottom liquid) is taken from product LPG recovery port 51 through line 30 and then utilized (step (h)).

The overhead vapor from second column 14 is supplied at −23° C. to second column overhead condenser 11 in second reflux line 27, is cooled to −24° C. and totally condensed, and flows through line 27*a* (step (d)).

The totally condensed ethane gas (ethane liquid) flows through line 27*b* and second column reflux pump 13. A part thereof is supplied as reflux liquid to second column 14 through line 28. The remaining part is sent back to the overhead of first column 3 through third reflux line 29 (step (e)). The ethane liquid (recycle ethane liquid) sent back to first column 3 acts to facilitate separation in first column 3 by absorbing and concentrating propane and heavier hydrocarbons.

According to the separation and recovery apparatus illustrated in FIG. 4, a system without external refrigeration is obtained by using the cold heat of the liquid inside first column 3 as the cold heat source of second column overhead condenser 11 of second column 14.

Since the temperature inside first column 3 is sufficiently low, by using an anti-freezing liquid such as methanol as an intermediate heating medium, cold heat within first column 3 is recovered by side reboiler 5, then circulated through first circulation line 41*a* and second circulation line 41*b*, and used in second column overhead condenser 11.

First column side reboiler 5 also contributes to reducing the heat duty of first column bottom reboiler 4.

Table 4 summarizes material balance, recovery rates and energy consumptions for the separation and recovery apparatus illustrated in FIG. 4.

Figure 1:
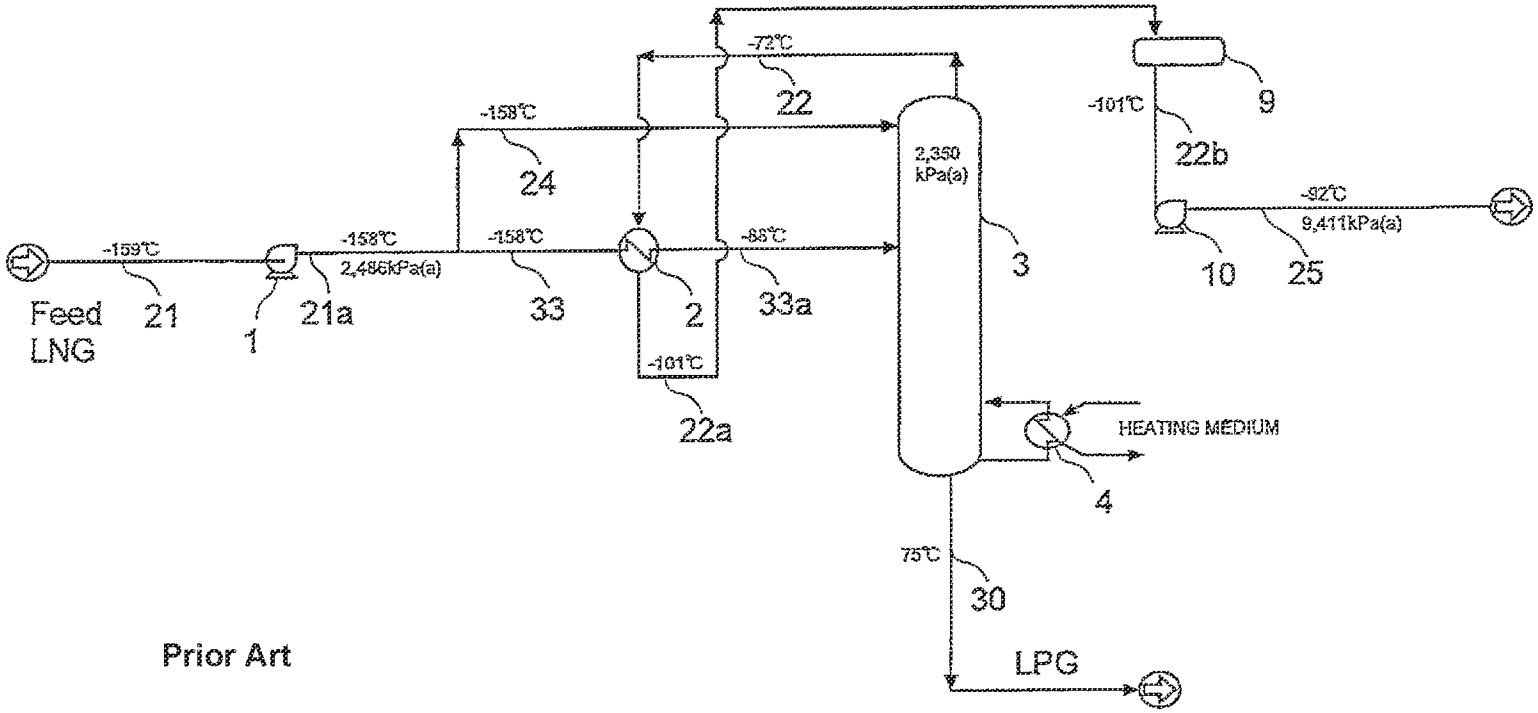
Prior Art Fig. 1
FIG. 1 is a flow diagram illustrating prior art separation of propane and heavier hydrocarbons from LNG in accordance with U.S. Pat. No. 6,510,706.
Figure 2:
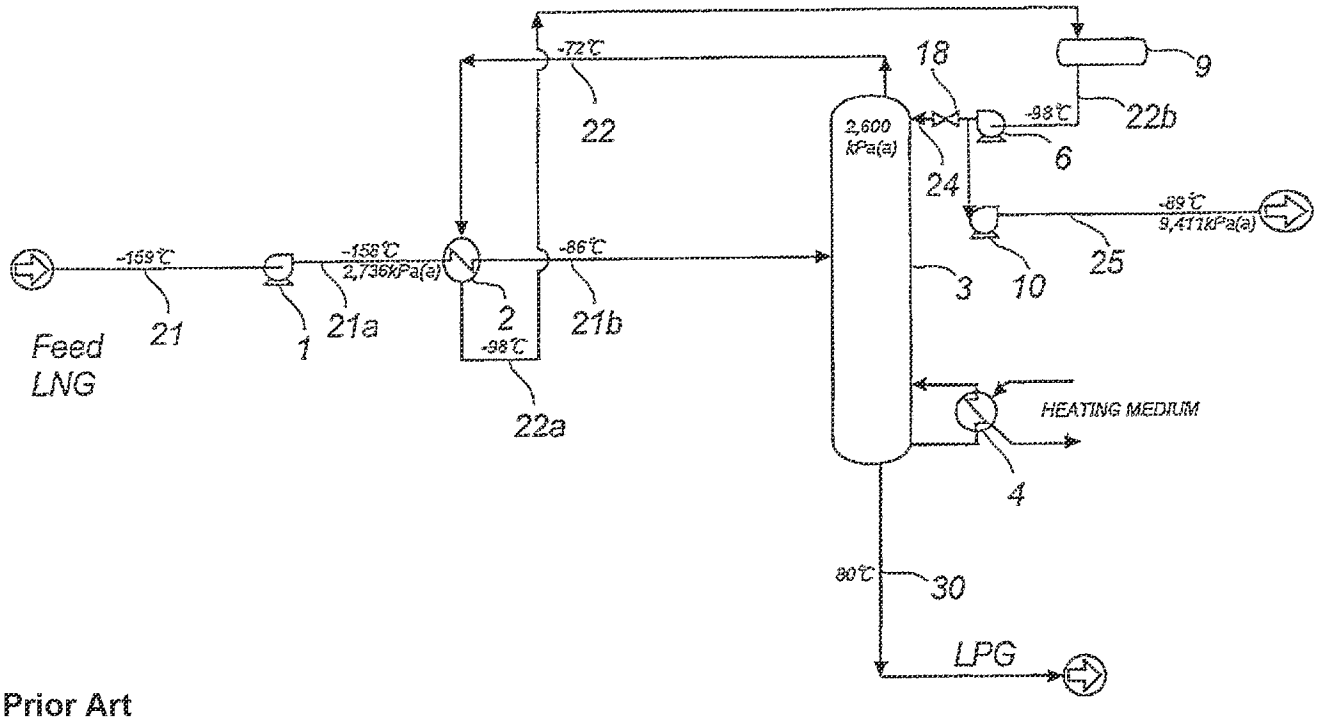
Prior Art Fig. 2
FIG. 2 is a flow diagram illustrating prior art separation of propane and heavier hydrocarbons from LNG in accordance with U.S. Pat. No. 2,952,984.
Figure 3:
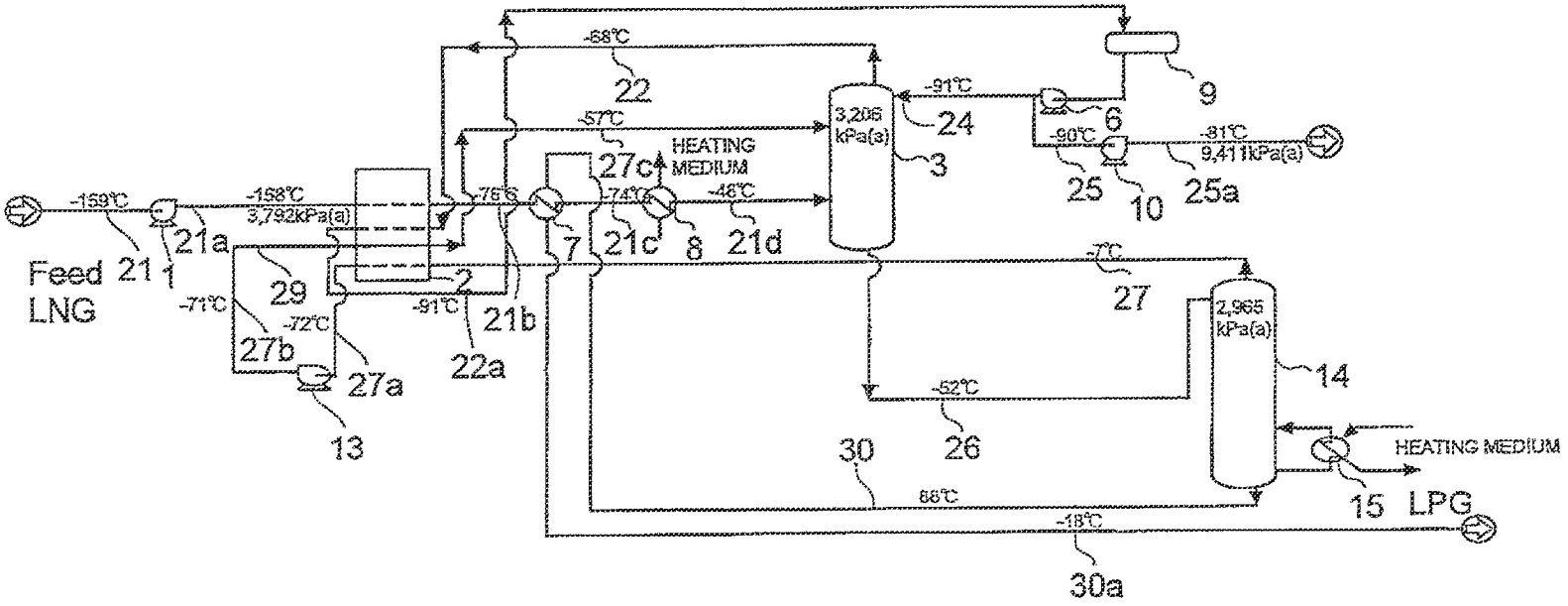
Fig. 3 Prior Art
FIG. 3 is a flow diagram illustrating prior art separation of propane and heavier hydrocarbons from LNG in accordance with U.S. Pat. No. 7,216,507.

The conditions, such as the composition, flow rate, temperature and pressure, of the feed LNG are made the same as those used in the processes shown in FIGS. 1 to 3 to calculate the material balance, the recovery rates and the energy consumptions.

TABLE 4

Material balance, Recovery Rate and Energy Consumption (FIG. 4)

Stream Flow Rate - kg moles/Hr

| Stream | Methane | Ethane | Propane | Butane | Total |
|---|---|---|---|---|---|
| 21 | 9,524 | 977 | 322 | 109 | 10,979 |
| 22 | 9,865 | 1,005 | 2 | 0 | 10,921 |
| 24 | 341 | 35 | 0 | 0 | 378 |
| 25 | 9,524 | 971 | 2 | 0 | 10,543 |
| 26 | 0 | 161 | 321 | 109 | 591 |
| 29 | 0 | 154 | 1 | 0 | 155 |
| 30 | 0 | 6 | 320 | 109 | 436 |

Recovery Rate

| | |
|---|---|
| Propane | 99.50% |
| Butane | 100.00% |

Required Power

| | |
|---|---|
| Feed LNG pump | 307 kw |
| First column reflux pump | 21 kw |
| Second column reflux pump | 12 kw |
| Product LNG pump | 1,331 kw |
| Total | 1,671 kw |

Supply of external heat

| | |
|---|---|
| First column bottom reboiler | 10,497 kw |
| Second column reboiler | 1,654 kw |
| Total | 12,151 kw |

The recovery rates of Table 4 are compared with the recovery rates of the related arts in Tables 1 to 3.

First, a higher propane recovery rate of 99.50% is achieved in Table 4 than a propane recovery rate in Table 1, 96.28%. It can be understood that this is because the overhead vapors of the first column and the second column 14 are used as reflux liquid, and thereby, higher reflux effect is obtained.

The propane recovery rates of Tables 2 and 3 are 99.47% and 99.03%, respectively. It can be said that the process regarding Table 4 have achieved an almost equivalent propane recovery rate of 99.50%.

Meanwhile, when reboiler heat duties are compared, the reboiler heat duty is 12,151 kW in Table 4, which is 15% lower than 14,319 kW and 14,302 kW of Tables 2 and 3, respectively. The total pump power is 1,671 kW in Table 4, which is similar to or lower than 1,687 kW and 1,913 kW in Tables 2 and 3, respectively.

The operating pressure of first column 3 is 2,065 kPaA in the process of FIG. 4, which is reduced lower than any of 2,350 kPaA, 2,600 kPaA and 3,206 kPaA of those of FIGS.

1, 2 and 3, respectively. Therefore, the separation efficiency is improved, the load in the column can be reduced, and the wall thickness of the pressure vessel of first column 3 can be thinner.

When the flow rates of overhead vapors are compared, 10,921 kg-moles/h in Table 4 is similar to 10,555 kg-moles/h in Table 1, and is lower than 12,404 kg-moles/h and 12,107 kg-moles/h in Tables 2 and 3, respectively.

In the process of FIG. 4, the separation efficiency is improved mainly by the following two factors.

First, first column 3 is relatively small through the use of a two-column separating apparatus, while a one-column separating apparatus is used in FIGS. 1 and 2. First column 3 accepts ethane liquid leak to the second column 14 instead of totally evaporating ethane, to reduce the load in first column 3.

Second, the propane concentration in the second overhead vapor can be reduced lower than that of the two-column apparatus of FIG. 3 by installing overhead condenser 11 in second column 14. Therefore, the propane concentration in the second reflux liquid to first column 3 can be lowered (the propane concentration is 6.9 mol. % in the line 27 of FIG. 3, while that of third reflux line 29 in FIG. 4 is only 0.6 mol. %).

As the quality of the second reflux liquid is better in FIG. 4, the amount of the first reflux liquid (stream 24 in FIGS. 3 and 4) can be reduced to 378 kg-mol/hr in FIG. 4 from 1,562 kg-mol/hr in FIG. 3. Then, the flow rate of the first overhead vapor in first overhead vapor line 22 can be reduced to 10,921 kg-mol/hr in FIG. 4 from 12,107 kg-mol/hr in FIG. 3.

Because of a lower flow rate of the first overhead vapor, cold heat duty required for the total condensation is reduced, and the operating pressure of first column 3 can be reduced to 2,065 kPaA in FIG. 4 from 3,206 kPaA in FIG. 3 for the total condensation of the first overhead vapor. A lower operating pressure of first column 3 can improve the separation efficiency, which in turn reduce the load in first column 3. In addition, the required wall thickness of a pressure vessel of first column 3 can be decreased.

(2) Apparatus and Process for Separation and Recovery of FIG. 5

A separation and recovery apparatus illustrated in FIG. 5 is substantially the same as the separation and recovery apparatus illustrated in FIG. 4 except that first column reflux pump 6 is not provided.

However, first column overhead condenser 2 and port 50 for taking the first overhead vapor condensed liquid are connected by first overhead vapor condensed liquid line 22*a* and 22*b* and product LNG discharge line 25, in which first column reflux drum 9 and product LNG pump 10 are provided.

First reflux line 24 connected to first column 3 is branched from between product LNG pump 10 and port 50 for taking the first overhead vapor condensed liquid. Hence, a part of the first overhead vapor condensed liquid can be returned as reflux liquid to first column 3 through the use of product LNG pump 10 and first reflux line 24 in the absence of first column reflux pump 6 (modified embodiment of step (g)).

Ethane, which is the second overhead vapor, is totally condensed through the use of cold heat of first column 3. A part thereof is supplied as a reflux liquid to the overhead of second column 14, and the remaining part is sent back as a second reflux liquid to first column 3. The ethane liquid (recycle ethane liquid) sent back to first column 3 acts to facilitate separation in first column 3 by absorbing and concentrating propane and heavier hydrocarbons.

Hence, the separation and recovery apparatus illustrated in FIG. 5 can maintain a high propane recovery rate, even when the amount of the first reflux liquid to the overhead of first column 3 in the separation and recovery apparatus illustrated in FIG. 4 is reduced due to the absence of the first column reflux pump 6.

Table 5 summarizes material balance, recovery rates and energy consumptions for the separation and recovery apparatus illustrated in FIG. 5.

TABLE 5

Material balance, Recovery Rate and Energy Consumption (FIG. 5)

Stream Flow Rate - kg moles/Hr

| Stream | Methane | Ethane | Propane | Butane | Total |
|---|---|---|---|---|---|
| 21 | 9,524 | 977 | 322 | 109 | 10,979 |
| 22 | 9,902 | 1,009 | 2 | 0 | 10,962 |
| 24 | 378 | 39 | 0 | 0 | 419 |
| 25 | 9,524 | 971 | 2 | 0 | 10,543 |
| 26 | 0 | 161 | 321 | 109 | 591 |
| 29 | 0 | 154 | 1 | 0 | 155 |
| 30 | 0 | 6 | 320 | 109 | 436 |

Recovery Rate

| | |
|---|---|
| Propane | 99.50% |
| Butane | 100.00% |

Required Power

| | |
|---|---|
| Feed LNG pump | 307 kw |
| Second column reflux pump | 12 kw |
| Product LNG pump | 1,384 kw |
| Total | 1,703 kw |

Supply of External Heat

| | |
|---|---|
| First column bottom reboiler | 10,443 kw |
| Second column reboiler | 1,670 kw |
| Total | 12,113 kw |

The propane recovery rate in Table 5 is 99.50%, and is the same as that in Table 4. Meanwhile, first column reflux pump 6 is removed, and a part of LNG pressurized by product LNG pump 10 is supplied as reflux liquid of first column 3 instead, in this process. Therefore, the total pump power is 1,703 kW in Table 5, which is 2% higher than 1,671 kW in Table 4. In the process of FIG. 5, since the pressurization is performed to achieve a higher pressure than a pressure required for the reflux, the temperature of the first reflux liquid becomes higher, and therefore the heat duty of first column bottom reboiler 4 is reduced from 10,497 kW (FIG. 4) to 10,443 kW, that is, by 0.5%. The choice between the embodiments of FIGS. 4 and 5 depends on costs of energy consumption and capital investment.

(3) Apparatus and Process for Separation and Recovery of FIG. 6

A separation and recovery apparatus illustrated in FIG. 6 has process equipment necessary for separation and recovery, including first column (first distillation column) 3 equipped with feed LNG pump 1, first column overhead condenser 2, first column bottom reboiler 4 and side reboiler 5, and second column (second distillation column) 14 equipped with second column overhead condenser 11 and second column bottom reboiler 15, from the upstream side toward the downstream side of LNG flow from the LNG feed source (LNG receiving terminal).

These units are interconnected by lines made of steel (e.g., stainless) pipes. Each line and line branch may be provided, if necessary, with a control valve, an on-off valve, various sensors such as a flow rate sensor, a pressure sensor and a temperature sensor, etc.

First column (first distillation column) 3 separates the feed LNG into a first overhead vapor mainly containing methane, and a first bottom liquid containing ethane, propane and heavier hydrocarbons.

First column bottom reboiler 4 and side reboiler 5 are provided to the bottom of first column 3. First column bottom reboiler 4 can employ a known heat exchanger using steam, heat transfer oil or the like in heating.

Second column (second distillation column) 14 is used for separating the first bottom liquid separated in first column 3 into a second overhead vapor and a second bottom liquid containing propane and heavier hydrocarbons.

Second column bottom reboiler 15 is provided to the bottom of second column 14. Second column bottom reboiler 15 can employ a known heat exchanger using steam, heat transfer oil or the like in heating.

The distillation column for use as first column 3 or second column 14 can employ a known multistage distillation column. The multistage distillation column may be any of tray columns and packed columns and is preferably of continuous distillation type.

The theoretical number of stages of the distillation column is not particularly limited and is preferably 5 or more stages, more preferably 10 or more stages.

The LNG feed source (LNG terminal) and first column 3 are connected through feed LNG line 21. Feed LNG line 21, 21*a* and 21*b* is provided with feed LNG pump 1 and first column overhead condenser 2 in order from the upstream side.

Feed LNG line 21*b* is connected to a middle of first column 3. The "middle" of first column 3 is in the range of, for example, the 5th to 10th stages for 15-stage first column 3. The same holds true for second column 14.

The overhead of first column 3 and first column overhead condenser 2 are connected by first overhead vapor line 22. First column overhead condenser 2 totally condenses and liquefies the first overhead vapor sent from the overhead of first column 3.

In first column overhead condenser 2, heat is exchanged between the feed LNG and the first overhead vapor, which flow within feed LNG line 21*a* and first overhead vapor line 22, so that the first overhead vapor can be totally condensed and liquefied to generate a first overhead vapor condensed liquid.

First column overhead condenser 2 and port 50 for taking the first overhead vapor condensed liquid are connected by first overhead vapor condensed liquid line 22*a* and 22*b* (and also by line 25), in order to transfer the first overhead vapor condensed liquid. First overhead vapor condensed liquid line 22*a* and 22*b* is provided with first column reflux drum 9 and product LNG pump 10. Product LNG pump 10 and port 50 for taking the first condensed liquid (product LNG) are connected by product LNG discharge line 25. In the embodiments shown in FIGS. 6 and 7, the whole of the first overhead vapor condensed liquid (line 22*b*) from drum 9 is discharged from port 50. In the embodiments shown in FIGS. 4 and 5, a part of the first overhead vapor condensed liquid (line 22*b*) from drum 9 is refluxed to first column 3, while the remaining of the first overhead vapor condensed liquid (line 22*b*) from drum 9 is discharged from port 50.

Port 50 for taking the first condensed liquid (product LNG) is connected to the LNG feed source (LNG receiving terminal). The LNG receiving terminal sends the product to each user.

The bottom of first column 3 and second column 14 are connected by first bottom liquid line 26 for transferring the first bottom liquid separated in first column 3.

Second column 14 is connected to second reflux line 27 and 28, through which the second reflux liquid flows from the overhead of second column 14 and returns to the first upper stage of second column 14.

Second reflux line 27, 27*a*, 27*b* and 28 is a line from the overhead of second column 14 through second column overhead condenser 11, second column reflux drum 12 and second column reflux pump 13 in order, back to the upper section of second column 14.

Further, the overhead of first column 3 and the line between second column reflux pump 13 and second column 14 are connected by third reflux line 29 for recycling ethane via first column overhead condenser 2.

Second column overhead condenser 11 and side reboiler 5 are connected by first circulation line 41*a* and second circulation line 41*b*, in order to circulate an anti-freezing liquid (intermediate heating medium).

Through first circulation line 41*a*, the anti-freezing liquid flows from second column overhead condenser 11 to side reboiler 5. Through second circulation line 41*b*, the anti-freezing liquid flows from side reboiler 5 to second column overhead condenser 11.

The anti-freezing liquid (intermediate heating medium) used can be methanol, ethanol, monoethylene glycol or the like.

The bottom of second column 14 is connected to recovery line 30 through which the second bottom liquid is taken.

The second bottom liquid contains propane and heavier hydrocarbons and is taken as product LPG.

Next, a process for separation and recovery of propane and heavier hydrocarbons using the separation and recovery apparatus illustrated in FIG. 6 will be described.

Feed LNG 21 which is from the LNG feed source (LNG receiving terminal) is supplied to a middle of first column 3 at −150° C. or lower (about −159° C.) through the use of feed LNG line 21. However, the supply at about −159° C. is carried out only immediately after the start of operation. During steady state operation, the stream is supplied to first column 3 at −96° C. because the first overhead vapor sent from first column 3 is heat-exchanged with the feed LNG of about −159° C. in first column overhead condenser 2.

In this operation, the feed LNG is pressurized by feed LNG pump 1 and sent to first column 3 having an operating pressure of 1,995 kPaA.

The feed LNG is distilled in first column 3, where a feed LNG liquid is repetitively brought into contact with vapor of the feed LNG. Thereby, a first overhead vapor, which is a low-boiling fraction, containing methane and a part of ethane is obtained by mass transfer to the overhead of the first column, and a first bottom liquid, which is a high-boiling fraction, containing remaining ethane, propane and heavier hydrocarbons is obtained by mass transfer to the bottom of the first column.

The first overhead vapor (about −77° C.) flows through first overhead vapor line 22 and then supplied to first column overhead condenser 2 where it is cooled to −106° C. by heat exchange with feed LNG 21*a* and totally condensed to obtain a liquid (first overhead vapor condensed liquid). In this operation, feed LNG 21*a* is heated to −96° C. and sent to the first column 3.

The first overhead vapor condensed liquid (−106° C.) flows through first overhead vapor condensed liquid line 22*a* and 22*b* and first column reflux drum 9 and is pressurized to 9,411 kPaA by product LNG pump 10. The pressurized liquid is sent through line 25 and returned at −98° C. to the LNG receiving terminal from port 50 for taking the first overhead vapor condensed liquid.

The bottom liquid of first column 3 is heated by first column bottom reboiler 4 to 31° C. under the condition that the C2/C3 molar ratio is 0.8.

The first bottom liquid is supplied to second column 14 through first bottom liquid line 26.

In second column 14, an ethane fraction is vaporized by heating in second column reboiler 15 so that column bottom product LPG (second bottom liquid) has a C2/C3 molar ratio of 0.02 or less. The temperature of the product LPG (second bottom liquid) is 50° C. under the condition that the operating pressure is 1,410 kPaA.

The product LPG (second bottom liquid) is taken from product LPG recovery port 51 through recovery line 30 and then utilized.

The second overhead vapor (ethane gas) from second column 14 is supplied at −20° C. to second column overhead condenser 11 in second reflux line 27, is cooled to −22° C. and totally condensed.

The ethane liquid obtained by the total condensation of the second overhead vapor enters second column reflux pump 13. A part thereof is supplied as a reflux liquid to second column 14. The remaining part is sent back as a second reflux liquid to first column overhead condenser 2 where it is subcooled to −91° C. and then sent back to first column 3.

The ethane liquid (recycle ethane liquid) sent back to first column 3 acts to facilitate separation in first column 3 by absorbing and concentrating propane and heavier hydrocarbons.

Hence, the separation and recovery apparatus illustrated in FIG. 6 can maintain a high propane recovery rate without first reflux liquid (line 24 in FIGS. 4 and 5) of the first overhead vapor condensed liquid to the overhead of first column 3.

According to the separation and recovery apparatus illustrated in FIG. 6, a system without external refrigeration is obtained by using the cold heat of the liquid inside first column 3 as the cold heat source of second column overhead condenser 11 of second column 14.

Since the temperature of the cold heat inside first column 3 is low enough to cool the second overhead vapor, heat exchange is carried out by circulating an intermediate heating medium between side reboiler 5 and second column overhead condenser 11 through first circulation line 41*a* and second circulation line 41*b*.

Also, side reboiler 5 contributes to reducing the heat duty of first column bottom reboiler 4.

Table 6 summarizes material balance, recovery rates and energy consumptions for the separation and recovery apparatus illustrated in FIG. 6.

The conditions, such as the composition, flow rate, temperature and pressure, of the feed LNG are made the same as those used in the processes shown in FIGS. 1 to 3 to calculate the material balance, the recovery rates and the energy consumptions.

TABLE 6

Material balance, Recovery Rate and Energy Consumption (FIG. 6)

| Stream Flow Rate - kg moles/Hr | | | | | |
|---|---|---|---|---|---|
| Stream | Methane | Ethane | Propane | Butane | Total |
| 21 | 9,524 | 977 | 322 | 109 | 10,979 |
| 22 | 9,524 | 971 | 2 | 0 | 10,543 |
| 25 | 9,524 | 971 | 2 | 0 | 10,543 |
| 26 | 0 | 257 | 322 | 109 | 688 |
| 29 | 0 | 251 | 1 | 0 | 252 |
| 30 | 0 | 6 | 320 | 109 | 436 |

| Recovery Rate | |
|---|---|
| Propane | 99.50% |
| Butane | 100.00% |

| Required power | |
|---|---|
| Feed LNG pump | 297 kw |
| Second column reflux pump | 13 kw |
| Product LNG pump | 1,336 kw |
| Total | 1,646 kw |

| Supply of external heat | |
|---|---|
| First column bottom reboiler | 9,526 kw |
| Second column reboiler | 2,379 kw |
| Total | 11,905 kw |

The propane recovery rate in Table 6 is the same as that in Table 4 (99.50%).

The amount of the recycle ethane in third reflux line 29 from second column 14 is increased to 252 kg-mol/hr in Table. 6 from 155 kg-mol/hr in Table. 4, instead of using first column reflux pump 6, so that the propane recovery rate can be kept at 99.50%.

The total pump power is 1,646 kW in Table 6, which is almost the same as 1,671 kW in Table 4.

Heat duty of first column bottom reboiler 4 is reduced by 9% from 10,497 kW in Table. 4 to 9,526 kW in Table. 6, because the C2/C3 molar ratio of first column 3 is increased to 0.8 to increase the amount of the recycle ethane in third reflux line 29.

Hence, dimension of first column 3 can be reduced in the embodiment of FIG. 6 compared with that in the embodiment of FIG. 4, although second column 14 becomes slightly larger than that in the embodiment of FIG. 4 due to the increased ethane leak. It is understood that the process illustrated in FIG. 6 can reduce capital investment while the energy consumption is similar with that in the embodiment of FIG. 4.

(4) Apparatus and Process for Separation and Recovery of FIG. 7

A separation and recovery apparatus illustrated in FIG. 7 is the same as that of FIG. 6 except that the apparatus is equipped with an additional feed LNG separator 16 and accordingly some lines are modified.

Feed LNG separator 16 is provided between first column overhead condenser 2 and first column 3. Feed LNG is heated by first column overhead condenser 2 to become a two-phase mixture. Feed LNG separator 16 separates the two-phase mixture into a vapor phase and a liquid phase.

The overhead of feed LNG separator 16 and the first overhead vapor line 22 are connected by vapor phase line 31. The vapor phase, which is separated from the heated feed LNG by feed LNG separator 16, flows through line 31.

The bottom of feed LNG separator 16 and first column 3 are connected by liquid phase line 32 for transferring the liquid phase separated by feed LNG separator 16. The separated liquid phase is supplied to a middle of first column 3 through liquid phase line 32 (step (i)).

In the apparatus illustrated in FIG. 7, feed LNG separator 16 is provided upstream of first column 3. The vapor phase separated by feed LNG separator 16 is mixed with the first overhead vapor from first column 3 through first overhead vapor line 22, while the vapor phase is bypassed around first column 3 (step (j)). Thus, the load in first column 3 can be reduced.

Table 7 summarizes material balance, recovery rates and energy consumptions for the separation and recovery apparatus illustrated in FIG. 7.

The conditions, such as the composition, flow rate, temperature and pressure, of the feed LNG are made the same as those used in the processes shown in FIGS. 1 to 3 to calculate the material balance, the recovery rates and the energy consumptions.

TABLE 7

Material balance, Recovery Rate and Energy Consumption (FIG. 7)

Stream Flow Rate - kg moles/Hr

| Stream | Methane | Ethane | Propane | Butane | Total |
|---|---|---|---|---|---|
| 21 | 9,524 | 977 | 322 | 109 | 10,979 |
| 22 | 3,447 | 878 | 1 | 0 | 4,331 |
| 25 | 9,524 | 971 | 6 | 0 | 10,548 |
| 26 | 0 | 318 | 318 | 109 | 745 |
| 29 | 0 | 312 | 2 | 0 | 313 |
| 30 | 0 | 6 | 316 | 109 | 431 |
| 31 | 6,077 | 92 | 5 | 0 | 6,217 |
| 32 | 3,447 | 885 | 317 | 109 | 4,762 |

Recovery Rate

| | |
|---|---|
| Propane | 98.28% |
| Butane | 99.65% |

Required Power

| | |
|---|---|
| Feed LNG pump | 340 kw |
| Second column reflux pump | 20 kw |
| Product LNG pump | 1,323 kw |
| Total | 1,683 kw |

Supply of External Heat

| | |
|---|---|
| First column bottom reboiler | 9,898 kw |
| Second column reboiler | 2,575 kw |
| Total | 12,473 kw |

The propane recovery rate in Table 7 is 98.28%, which is slightly lower than 99.50% in Table 6. The butane recovery rate in Table 7 is also reduced to 99.65% from 100.00% in Table 6.

This means slight loss of propane and butane from the upper vapor of feed LNG separator 16, this upper vapor bypassing first column 3.

The flow rate of feed LNG 32 to be supplied to first column 3 is 4,762 kg-mol/hr in Table 7, which is only 43% of 10,979 kg-mol/hr as that of feed LNG 21 in Table 6. This can reduce the load in first column 3 and decrease the size of the first column.

The total pump power is 1,683 kW in Table 7, which is almost the same as 1,646 kW in Table 6.

The flow rate of the bottom liquid of first column 3 is increased from 688 kg-mol/hr in Table. 6 to 745 kg-mol/hr in Table. 7 to increase the load in second column 14, because the amount of recycle ethane sent through third reflux line 29 is increased. First column overhead condenser 2 needs to supply a larger amount of cold heat from the feed LNG to the recycle ethane, and therefore, a smaller amount of cold heat of feed LNG 21*a* can be used for cooling the first overhead vapor of first column 3.

As a result, the operating pressure of first column 3 must be elevated to 2,180 kPaA in FIG. 7 compared with 1,995 kPaA in FIG. 6, in order to totally condense the first overhead vapor.

This also slightly reduces the separation efficiency of first column 3. As a result, the total reboiler heat duty is 12,473 kW in FIG. 7, which is 5% higher than 11,905 kW in FIG. 6.

Comparing the flow rate of the first overhead vapor in first overhead vapor line 22, the flow rate can be reduced to 4,331 kg-mol/hr in FIG. 7, which is only 41% of 10,543 kg-mol/hr in FIG. 6. The choice between the embodiments of FIGS. 6 and 7 depends on the profits derived from the product LPG and capital investment.

As another embodiment of the apparatus of the present invention, feed LNG line 21 illustrated in FIGS. 4 to 7 may be provided with a feed LNG preheater.

By using utility at a low-temperature level, such as sea water, as the heat source of the feed LNG preheater, the duty of a heat source at a high-temperature level which is needed for bottom reboiler 4 of first column 3 can be reduced (step (k)).

In addition, feed LNG may be preheated by heat recovered from the product LPG to reduce the load in first column bottom reboiler 4 of first column 3 (step (l)).

As the composition of feed LNG becomes lighter, total condensation in first column overhead condenser 2 becomes difficult. Therefore, the operating pressure of first column 3 can be adjusted properly depending on the composition of the feed LNG.

The cold heat required for second column overhead condenser 11 is provided by heat exchange with an internal liquid at a middle of first column 3, in the preceding embodiments. Alternatively, the cold heat may be provided by using, for example, an external refrigerant such as ethane, ethylene, propane or propylene.

In the preceding embodiments, ethane contained in feed LNG remains almost entirely in the product LNG, and ethane is not recovered as product ethane. Alternatively, the ethane may be partially recovered in such a way that the amount of ethane recycled from second column 14 to first column 3 is decreased while the corresponding amount (corresponding to the decrease of recycle ethane) of ethane is sent out as a product. The operating pressure of first column 3 can be adjusted depending on the amount of the recycle ethane, in order to totally condense the first overhead vapor of first column 3.

The present invention adopts a two-column apparatus configuration. If the apparatus is to be installed in a narrow area, first column 3 and second column 14 may be vertically arranged and integrally stacked, so that the resulting apparatus structure may look as if it were one-column distillation apparatus.

The apparatus and the process of the present invention can efficiently separate and recover propane and butane from LNG as compared with prior arts and can reduce the load in the column and energy consumptions as compared with prior arts.

FIGS. 4 to 7 illustrate the preferred embodiments of the present invention. However, the present invention is not limited by these embodiments. Any change or modification can be made in these embodiments depending on the feed LNG composition or other conditions without departing from the technical scope of claims.

The separation and recovery apparatus of the present invention can be utilized as an apparatus for separation and recovery of propane and heavier hydrocarbons from LNG.

1: Feed LNG pump, 2: First column overhead condenser, 3: First column, 4: First column bottom reboiler, 5: First column side reboiler, 6: First column reflux pump, 9: First column reflux drum, 10: Product LNG pump, 11: Second column overhead condenser, 12: Second column reflux drum, 13: Second column reflux pump, 14: Second column, 15: Second column reboiler 16: Feed LNG separator.

What is claimed is:

1. A method for separating hydrocarbons wherein feed liquefied natural gas (LNG) containing methane, ethane, and a hydrocarbon having 3 or more carbon atoms including at least propane is separated into a liquid fraction enriched in methane and ethane and a liquid fraction enriched in the hydrocarbon having 3 or more carbon atoms, comprising:

(a) heating the feed LNG in a first column overhead condenser to partially vaporize the feed LNG to obtain a vapor-liquid two-phase stream;

(b) supplying the whole or a liquid phase of the vapor-liquid two-phase stream to a middle of a first column so that the supplied vapor-liquid two-phase stream is separated by the first column into a first overhead vapor enriched in methane and ethane, and a first bottom liquid enriched in the hydrocarbon having 3 or more carbon atoms;

(c) separating the first bottom liquid into a second overhead vapor enriched in ethane and a second bottom liquid enriched in the hydrocarbon having 3 or more carbon atoms by a second column;

(d) totally condensing the second overhead vapor in a second column overhead condenser to obtain a condensed liquid of the second overhead vapor;

(e) supplying a part of the condensed liquid of the second overhead vapor directly to the first column after being subcooled by heat exchange with the feed LNG, so that the supplied condensed liquid absorbs and condenses propane and heavier hydrocarbons to facilitate separation in the first column, while refluxing the remaining part to the second column;

(f) totally condensing whole of the first overhead vapor obtained from step (b) by heat exchange with the feed LNG before being supplied to the first column in the first column overhead condenser to obtain a condensed liquid of the first overhead vapor;

(g) discharging the whole of the liquid stream obtained from step (f) as the liquid fraction enriched in methane and ethane without refluxing the liquid stream obtained from step (f) to the first column; and (h) discharging the second bottom liquid as the liquid fraction enriched in the hydrocarbon having 3 or more carbon atoms.

2. The method according to claim 1, wherein the second overhead vapor is totally condensed by heat exchange with an internal liquid of the first column in step (d).

3. The method according to claim 2, wherein the heat exchange in step (d) is performed to totally condense the second overhead vapor by recovering cold heat within the first column by heat exchange with an intermediate heating medium, which is an anti-freezing liquid, in a side reboiler of the first column, and by cooling the second overhead vapor in the second column overhead condenser by the cooled intermediate heating medium.

4. The method according to claim 3, wherein the intermediate heating medium is selected from methanol, ethanol and monoethylene glycol.

5. The method according to claim 1, wherein the second overhead vapor is totally condensed by using an external refrigerant selected from ethane, ethylene, propane and propylene in the step (d).

6. The method according to claim 1, further comprising:

(i) performing vapor-liquid separation of the two-phase stream obtained from step (a), and (j) mixing a vapor phase obtained from the vapor-liquid separation with the first overhead vapor, wherein a liquid phase obtained from the vapor-liquid separation is supplied to the first column in step (b).

7. The method according to claim 1, comprising, after step (a):

(k) preheating the feed LNG through the use of a heat source at a low temperature level, such as sea water; or (l) preheating the feed LNG through the use of cold heat recovered from the liquid fraction enriched in the hydrocarbon having 3 or more carbon atoms.

* * * * *